US008231352B2

(12) United States Patent
Hunt et al.

(10) Patent No.: US 8,231,352 B2
(45) Date of Patent: Jul. 31, 2012

(54) VIBRATION DAMPER ASSEMBLY

(75) Inventors: David J. Hunt, Lichfield (GB); Wesley J. Pearce, Derby (GB); Robert Elliott, Derby (GB)

(73) Assignee: Rolls-Royce PLC, London (GB)

( * ) Notice: Subject to any disclaimer, the term of this patent is extended or adjusted under 35 U.S.C. 154(b) by 1262 days.

(21) Appl. No.: 12/149,493

(22) Filed: May 2, 2008

(65) Prior Publication Data

US 2010/0034657 A1 Feb. 11, 2010

(30) Foreign Application Priority Data

May 25, 2007 (GB) ..... 0710042.3

(51) Int. Cl.
*F01D 5/10* (2006.01)

(52) U.S. Cl. ..... 416/190; 416/500; 277/641; 277/644

(58) Field of Classification Search ..... 416/190, 416/195, 196 R, 500; 277/630, 641, 644
See application file for complete search history.

(56) References Cited

U.S. PATENT DOCUMENTS

| | | | | |
|---|---|---|---|---|
| 1,423,466 | A * | 7/1922 | Snyder | 416/191 |
| 3,752,599 | A | 8/1973 | Pace | |
| 3,990,813 | A * | 11/1976 | Imai et al. | 416/196 R |
| 4,407,634 | A * | 10/1983 | Tones | 416/196 R |
| 5,158,430 | A * | 10/1992 | Dixon et al. | 415/134 |
| 5,624,227 | A * | 4/1997 | Farrell | 415/139 |
| 5,730,584 | A * | 3/1998 | Dodd | 416/190 |
| 5,975,844 | A | 11/1999 | Milazar et al. | |
| 6,371,727 | B1 * | 4/2002 | Stangeland et al. | 416/190 |
| 6,926,284 | B2 * | 8/2005 | Hirst | 277/603 |
| 7,104,758 | B2 * | 9/2006 | Brock et al. | 416/190 |
| 7,527,472 | B2 * | 5/2009 | Allen | 415/139 |
| 2004/0051254 | A1 | 3/2004 | Smed | |

FOREIGN PATENT DOCUMENTS

| | | |
|---|---|---|
| EP | 0 806 545 A1 | 11/1997 |
| EP | 0 896 128 A2 | 2/1999 |
| JP | A-61-049103 | 3/1986 |

* cited by examiner

*Primary Examiner* — Edward Look
*Assistant Examiner* — Andrew C Knopp
(74) *Attorney, Agent, or Firm* — Oliff & Berridge, PLC

(57) ABSTRACT

A vibration damper assembly for damping non-synchronous vibration between adjacent, spaced apart components comprises a vibration damper located in both of a pair of generally confronting passages in each of the components. The assembly comprises at least two spaced apart articulation surfaces for contact between damper and component, each of the articulation surfaces is arcuate in a first direction and is characterized by having a substantially linear portion in an orthogonal and second direction. Thereby the contact area is greatly enlarged and material loss minimized. The cross-sectional shape of the damper or passage is non-circular and there is a clearance between the damper and passage sufficiently small to prevent rotation of the damper in the passage during use.

12 Claims, 4 Drawing Sheets

Related Art

VIBRATION DAMPER ASSEMBLY

This invention relates to vibration damping and is particularly, but not exclusively, concerned with the damping of vibrations in aerofoil blades suitable for use in gas turbine engines.

BACKGROUND

Gas turbine engines commonly include an axial flow turbine that comprises at least one annular array of radially extending aerofoil blades mounted on a common disc. Each aerofoil blade is sometimes provided with a shroud at its radially outer tip so that the shrouds of adjacent blades cooperate to define a radially outer circumferential boundary to the gas flow over the aerofoil blades.

In operation, there can be a tendency for the gas flows over the aerofoil blades to cause the blades to vibrate to such an extent that they require some degree of damping. One way of achieving such damping is to interconnect the shrouds of the blades with a single length of wire that passes through appropriate circumferentially extending passages provided in the shrouds. Any vibration of the blades results in relative movement between their shrouds and hence between the passages and the wire. Friction between the passage walls and the wire tends to dampen such relative movement, and hence the blade vibration. Such an arrangement is described and shown in Swiss Patent No. 666326. The drawback with this type of arrangement, however, is that the wire adds undesirable weight to the blade assembly.

EP0806545B1 discloses a damper for damping non-synchronous vibration in adjacent shrouded aerofoil blades in the form of pin that locates in confronting passages in adjacent blade shrouds. The pin is provided with larger diameter portions that are located totally within the passages and frictionally engage the surfaces of the passages to provide vibration damping. The pin is circular in cross section and the larger diameter pin portions are interconnected by a central, thinner portion. The configuration of the pin reduces the likelihood of it wearing in such a manner that it jams in the passages and no longer provides vibration damping. However, during engine running the damper experiences excessive wear resulting in loss of material and a reduction in damper mass. Due to the small size of the damper, this mass loss constitutes a significant proportion of its mass. The reduction in damper mass causes damping effectiveness to be compromised.

SUMMARY

Therefore it is an object of the present invention to provide an improved arrangement for a damping element that reduces mass loss through wear.

In accordance with an embodiment of the present invention a gas turbine engine is provided that comprises vibration damper assembly for damping non-synchronous vibration between adjacent, spaced apart components, the assembly comprises a vibration damper located in both of a pair of generally confronting passages, one passage being provided in each of the adjacent components, the assembly comprises at least two spaced apart articulation surfaces for contact between damper and component, each of the articulation surfaces is arcuate in a first direction and is characterised by having a substantially linear portion in a second direction.

Preferably, at least one of the articulation surfaces is formed by the vibration damper.

Preferably, the damper comprises a neck portion having a minimum cross-sectional area and two head portions, each having a maximum cross-sectional area, either side of the neck portion, the head portions define the articulation surfaces.

Normally, at least one of the head portions comprises a tapering portion.

Preferably, the neck portion comprises a generally varying cross-sectional area.

Alternatively, the neck portion comprises a generally constant cross-section.

Alternatively, at least one of the articulation surfaces is formed by the component in the passage. Preferably, the damper has a generally constant cross-sectional area in its contact surface.

Alternatively there is a combination of the articulation surfaces formed on the damper and/or by the component in the passage.

Preferably, the cross-sectional shape of the damper or passage is non-circular and there is a clearance between the damper and passage sufficiently small to prevent rotation of the damper in the passage during use.

Normally, the cross-sectional shape of the damper or passage is polygonal.

Preferably, the cross-sectional shape of the damper or passage is rectangular.

Normally, the components are adjacent blades of an annular array, mounted to a disc in a gas turbine engine.

BRIEF DESCRIPTION OF THE DRAWINGS

The disclosed embodiments of the present invention will be more fully described by way of example with reference to the accompanying drawings in which.

DETAILED DESCRIPTION OF EMBODIMENTS

Figure 1:
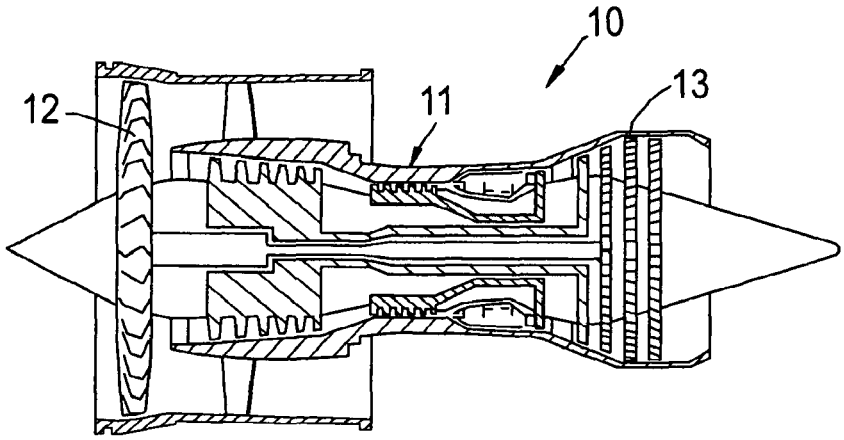
FIG. 1 is a simplified sectioned side view of a ducted fan gas turbine engine incorporating one embodiment of the present invention.

With reference to FIG. 1, a ducted fan gas turbine engine generally indicated at 10 is of generally conventional configuration and operation. It comprises a core unit 11 which serves to drive a propulsive ducted fan 12 and also to provide propulsive thrust. The core unit 11 includes a low pressure turbine 13 which comprises three rotary stages of aerofoil blades.

Figure 2:
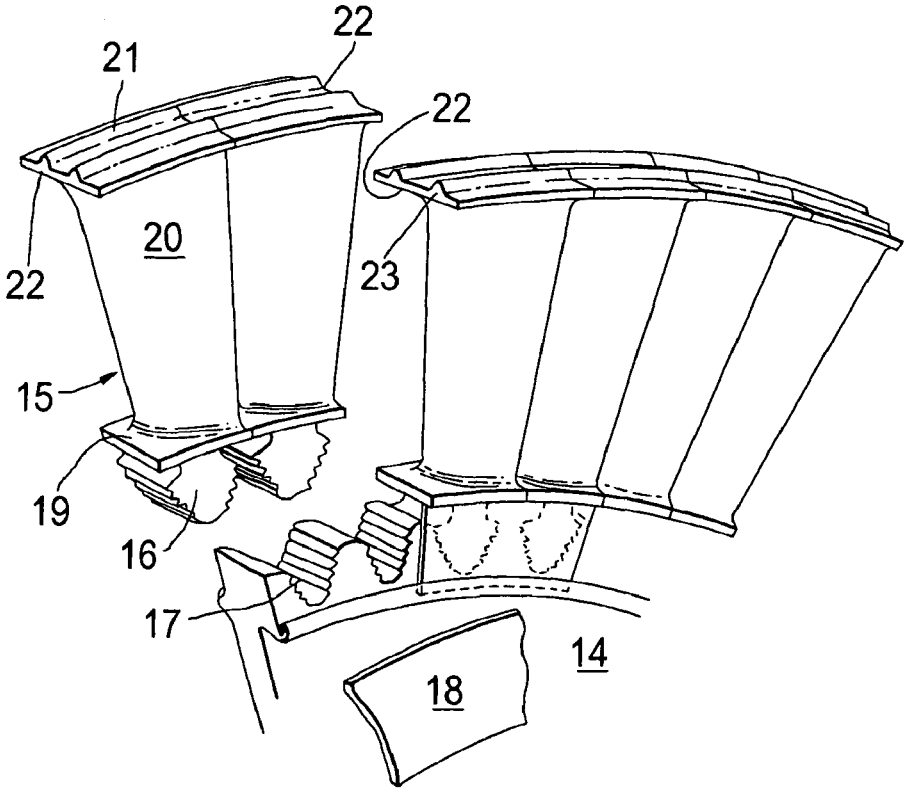
Related Art Fig.2
FIG. 2 is a partially exploded view of part of the turbine of the ducted fan gas turbine engine shown in FIG. 1.

Part of one of those low pressure turbine stages can be seen in FIG. 2. It comprises a disc 14 having a plurality of similar radially extending aerofoil blades 15 mounted on its periphery. Each aerofoil blade 15 is preferably formed from a suitable nickel base alloy and has a conventional fir tree cross-section root 16 which locates in a correspondingly shaped slot 17 provided in the disc 14 periphery. The configuration of the root 16 ensures radial constraint of its corresponding aerofoil blade 15 while permitting the root 16 to be slid axially into its corresponding slot 17 in the disc periphery for assembly purposes. Suitable stops (not shown) and seal plates 18 which are subsequently attached to the disc 14 and aerofoil blades 15 ensure the axial retention of the aerofoil blades 15 on the disc.

In addition to having a root 16, each aerofoil blade 15 comprises an inner platform 19 positioned adjacent the root 16, an aerofoil portion 20 extending radially outwardly from the inner platform 19 and a shroud 21 positioned on the radially outer extent of the aerofoil portion 20. The inner platforms 19 of adjacent aerofoil blades 15 co-operate to define a radially inner boundary to the gas path over the aerofoil portions 20. Similarly, the shrouds 21 of adjacent aerofoil blades 15 co-operate to define a radially outer boundary to the gas path over the aerofoil portions 20.

Each of the inner platforms 19 and outer shrouds 21 is circumferentially spaced apart by a small distance from its adjacent platform 19 or shroud 21. This is to allow for the vibration of the aerofoil blades 15 which inevitably occurs when gases flow over them during operation of the engine 10. It is this gas flow which causes the aerofoil blades 15 to rotate the disc 14 upon which they are mounted.

Excessive aerofoil blade vibration is usually looked upon as being undesirable since it can lead to premature component failure through cracking. The disclosed embodiments are concerned with the damping of vibration in order to avoid such premature component failure.

Figure 3:
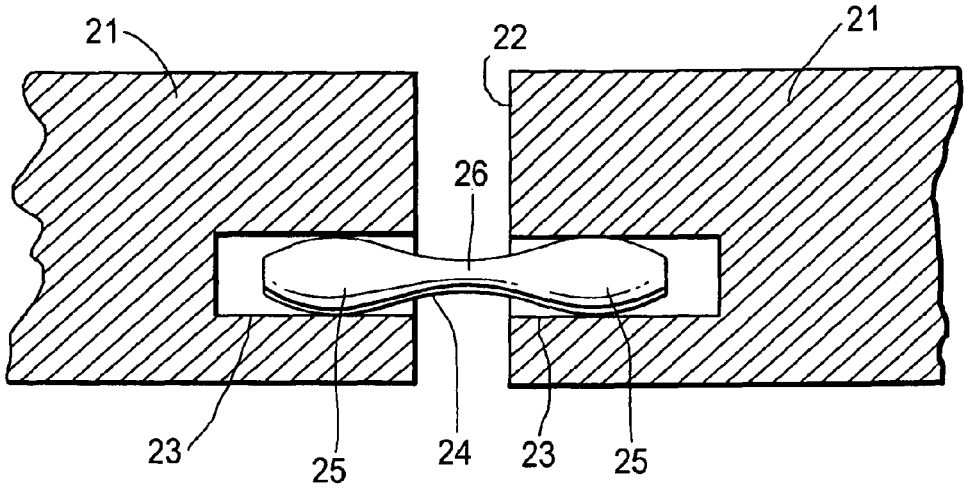
FIG. 3 is a section through adjacent shrouds of turbine blades including a related art vibration damper.

In EP0806545 vibration damping is provided by dampers that are associated with each of the shrouds 21. Each shroud 21 is provided at each of its circumferential edges 22 with a blind circumferentially extending circular cross-section passage 23. Each passage 23, as can be seen more clearly in FIG. 3, confronts the passage in the adjacent shroud 21. Each pair of confronting shroud passages 23 contains a damper (or pin) 24 which is in the form of a metallic pin interconnecting the adjacent shroud passages 23. The pin 24, which is preferably formed from a nickel base alloy, is of circular cross-sectional configuration and has portions that are of greater diameter than other portions. More specifically, the pin 24 has two similar larger diameter portions 25 that are interconnected by a smaller diameter portion 26.

Additionally the pin 24 diameter varies progressively from its smaller diameter central portion 26 to each of its larger diameter portions 25 and thence decreases to each of its ends.

The greatest circumference part of each larger diameter pin portion 25 is so positioned on the pin 24 that each of the portions 25 of the pin 24 that engages the internal wall of its associated shroud passage 23 is totally contained within that passage 23.

If the aerofoil blades 15 are subject in use to non-synchronous vibration, there will be relative movement between the blades 15. Since the aerofoil blades 15 are attached to the disc 14 at their radially inner extents, that relative movement tends to be of greatest magnitude in the region of the blade shrouds 21. The vibration is likely to be in one or both of two main modes: flutter and torsional oscillation. Notwithstanding the particular mode or modes involved, vibration of the blades 15 results in adjacent shrouds 21 moving relative to each other in both circumferential and axial directions (with respect to the longitudinal axis of the engine 10). Such relative shroud 21 movement results in the pins 24 sliding within the passages 23. This sliding movement is resisted by friction between the walls of the passages 23 and those portions of the pins 24 that engage those walls, thereby providing damping of the movement. The pins 24 therefore provide damping of non-synchronous vibration of adjacent aerofoil blades 15.

The circular section damper is employed in one of the Applicant's commercial aeroengines. Here there is a clearance between the damper 24 and passage 23, resulting in a point contact. The passage 23 has a diameter of 3.80.+–.0.10 mm and the damper 24 a diameter of 3.00.+–.0.10 mm. The damper 24 damper 26 is free to move in the passages 23 until centrifugal load is sufficient to move it to a radially outer point of the surface of the passage 23. In service, the damper 24 in particular suffers from localised wear on the small contact patch resulting from the position assumed by the damper 24 when under centrifugal load.

The circular cross-sectional shape of the damper 24 results in a very small contact area when new and subsequently a high wear rate in service. The axisymmetric form of the damper 24 allows it free rotation during service such that a new contact point may be exposed to wear during each flight or engine cycle. Subsequently, the damper 24 does not appear to settle into a predictable wear pattern where the wear may be expected to slow after the initial bedding-in period. Instead, the free rotation permits a high wear condition to persist throughout the life of the damper 24.

It has been found that this irregular wear produces a faceted shape and the damper's mass is significantly reduced which compromises its effectiveness. With each wear cycle, a new region of the damper's 24 circumference is exposed. Therefore contact area is once again at a minimum and wear rate at a maximum.

This is clearly undesirable and the disclosed embodiments are directed at reducing wear rates and to provide a more effective damping assembly for blades during service life.

Figure 4:
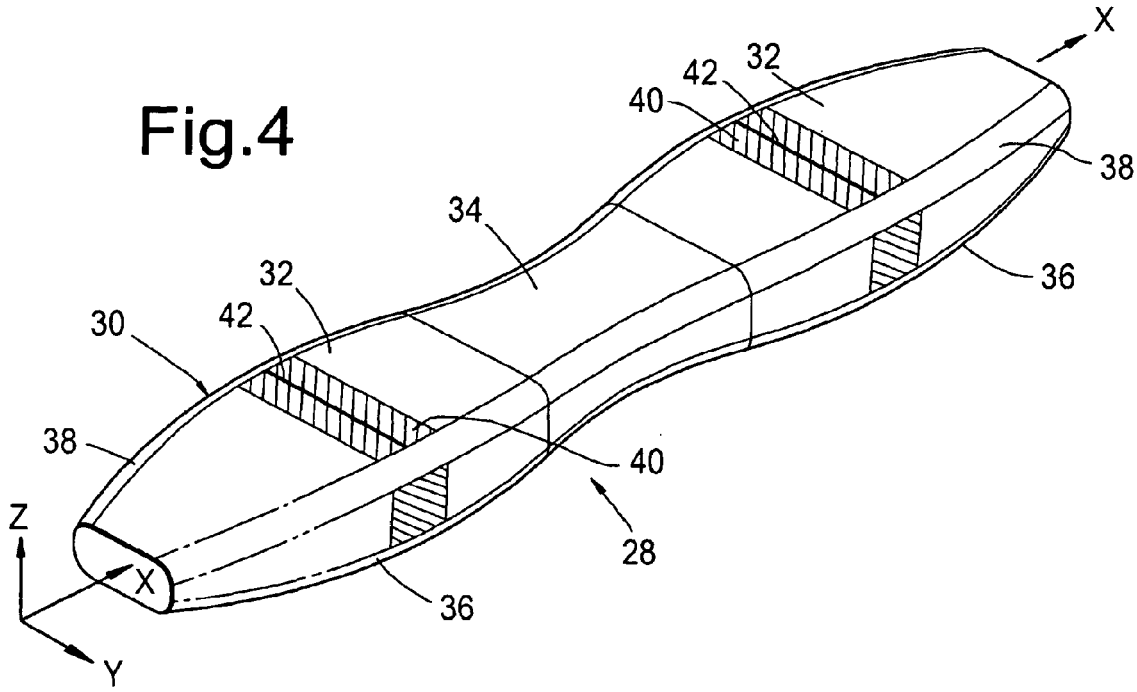
Related Art Fig.4
FIG. 4 is a perspective view of a first embodiment of a vibration damper assembly in accordance with the present invention.
Figure 5:
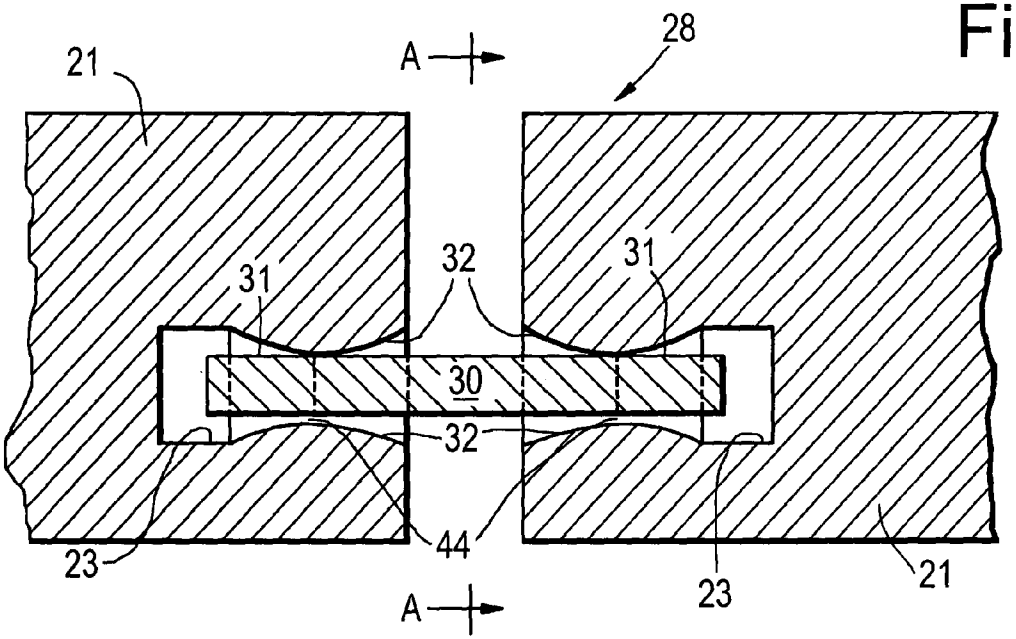
FIG. 5 is a section through adjacent shrouds of turbine blades including a second embodiment of a vibration damper assembly in accordance with the present invention.

Referring now to FIGS. 4 and 5; in one embodiment, the present invention is directed to a vibration damper assembly 28 comprising a vibration damper 30 located in both of the pair of generally confronting passages 23, the assembly comprises at least two spaced apart articulation surfaces 32 for contact between damper 30 and component 21. Each of the articulation surfaces 32 is arcuate in a first direction and is characterised by having a substantially linear portion 42 in an orthogonal and second direction.

The articulation surfaces 32 may be formed by either the vibration damper 30 (FIG. 4) or the component 21 in the passage 23 (FIG. 5).

In a first embodiment of the present invention seen in FIG. 4, the vibration damper 30 forms the articulation surfaces 32. The vibration damper 30 has an x-axis running along its longitudinal axis, a y-axis denotes its width and a z-axis denotes its thickness or depth in the radial direction when in situ in the rotor blade 21. In this embodiment and when in use the x-axis is generally orientated in a general circumferential sense, noting that the damper's x-axis will be a tangent. The z-axis will describe the damper's radial thickness and the y-axis will be aligned with a rotational axis of the engine. Thus the articulation surfaces 32 are arcuate in a first direction (i.e. along the x-axis) and is characterised by having a substantially linear portion 42 in an orthogonal and second direction i.e. along the y-axis.

The articulation surfaces 32 allow the damper 30 to be angled between the components 21 without 'trapping' and inducing encastre-type bending moments and stresses. Desirably, there will be friction resistance to the relative component movement with the damper 30 and passage 23 sliding relative to one another, thereby damping non-synchronous vibrations between adjacent blades.

The damper 30 comprises a neck portion 34 having a minimum cross-sectional area. To each side of the neck portion 34 is a head portion 36 that defines a maximum cross-sectional area; the cross-sectional area progressively increasing between minimum and maximums. The head portions 36 then taper towards the two ends of the damper 30. The head portions 36 define the articulation surfaces 32 which contact the passages 23, initially at the maximum cross-sectional area position 42. The passage 23 is of a complimentary and generally rectangular shape having a corresponding linear portion in the y-axis direction. The passage 23 is preferably linear in the x-axis, but could be arcuate.

In this exemplary embodiment the damper 30 has a generally rectangular cross section with radiused edges 38. This general 'hour glass' form is similar to the prior art damper in order to allow articulation in multiple directions as the blades 21 move relative to one another.

The radially upper articulation surfaces 32 are subject to the greatest frictional forces as the damper is centrifuged radially outwardly. The rectangular cross-section initially provides a relatively long contact line 42, which during use wears to produce a large contact patch 40. Note that the blades 21 will move radially, circumferentially and axially relative to one another causing the damper 30 to move in and out of the passage 23 causing wear. Once bedded in, the large surface contact area 40 minimises any further wear and mass loss. This damper 30 also permits a larger mass for a given radial height (due to increased width) such that a higher mass of damper 30 may be fitted into a given shroud 22 radial depth.

Preferably and as shown in FIG. 4, the vibration damper 30, along its x-axis, comprises a smooth profile where the neck portion 34 defines concave surfaces that transition into convex surfaces 32 of the head portions 36. Thus along its x-axis the cross-sectional area of the damper 30 constantly varies. Although it should be appreciated that wear may cause the profile to flatten as shown by the wear patches 40. Alternatively, the neck portion 36 may be of a constant cross section, with a geometric step to the head portions 36 similar to a dumbbell. The head portions 36, despite the flattening of the contact patches 40, needs to be arcuate to allow articulation of the damper in the passages 23.

The shape and aspect ratio of the damper 30/passage 23 and clearances 44 (see FIG. 5) between the damper 30 and the passage 23 are intended to prevent any undesirable rotation of the damper 30. A preferred cross-section shape, as shown in FIG. 4, is generally rectangular as this provides a relatively large wear patch 40 for rotating components 21 where their relative movement and therefore damping is required in the radial direction.

Figure 6:
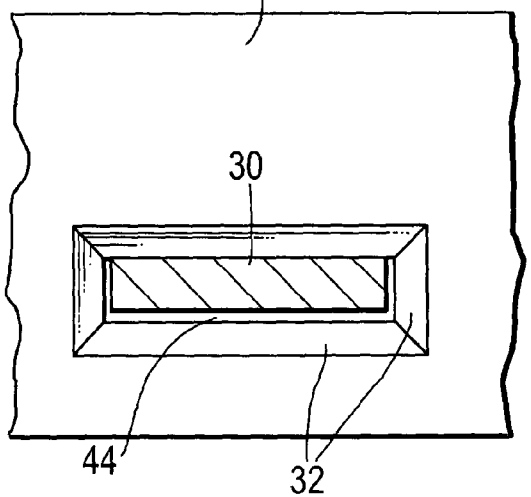
FIG. 6 is a section AA in FIG. 5.
Figure 7:
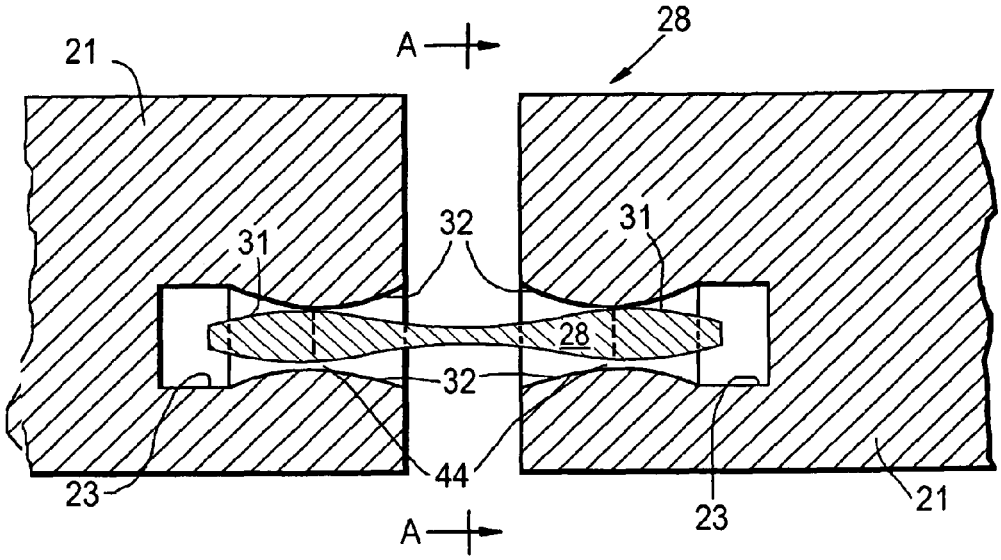
FIG. 7 is a section through adjacent shrouds of turbine blades including a vibration damper according to an embodiment of the present invention.

Referring now to FIGS. 5 and 6 that show the second embodiment of the present invention; the vibration damper assembly 28 again comprises the vibration damper 30 located in both of a pair of generally confronting passages 23 in each of the adjacent components 21, however, the articulation surfaces 32 are formed by the component 21 in the passage 23. In accordance with the teachings of at least one of the disclosed embodiments of the present invention each of the articulation surfaces 32 is arcuate in a first direction and is characterised by having a substantially linear portion 42 in a second direction. In this embodiment, the damper 30 has a generally constant cross-sectional area in its contact surface 31. Advantageously, in this embodiment, the damper 30 is made from a material which preferentially wears and as it is generally of a straight bar configuration is cheap to manufacture and therefore to replace.

It should be appreciated that the vibration damper assembly 28 may comprise a combination of articulation surfaces 32 formed on the damper 30 and/or by the component 21 in the passage 23.

Although the disclosed embodiments of the present invention have been described with reference to the damping of turbine blades, it will be appreciated that it is generally applicable to other situations in which two adjacent components are subject to non-synchronous vibration. Moreover, although the disclosed embodiments of the present invention have been described with respect to single turbine blades which are interconnected by damping pins, it may be desirable in certain circumstances to utilise turbine blades which are grouped in pairs. Thus an adjacent pair of turbine blades would share integral shrouds and platforms. Under these circumstances only the circumferential extents of the common shrouds would be provided with pin-receiving passages.

Although the preferred cross-sectional shape of the damper 30 and the passage 23 is generally rectangular, orientated so that the longest side is upper most where the greatest wear occurs, the exact dimensions of its width and depth may be chosen dependent on the amplitude, magnitude and direction of relative component movements.

One important aspect of the present invention is that the cross-sectional shape of the damper 30 and/or passage 23 is non-circular and the clearance 44 between the damper 30 and passage 23 is sufficiently small to prevent rotation of the damper 30 in the passage 23 during use. Although the cross-sectional shape of the damper 30 and/or passage 23 is polygonal, a preferable shape is rectangular. Other shapes may be possible as long as a greatest dimension of the damper 30 is larger than a smallest dimension of the passage 23, the damper should not be able to rotate.

We claim:

1. A vibration damper assembly, having a longitudinal x-axis and mutually perpendicular y and z-axes, for damping non-synchronous vibration between adjacent, spaced apart components, the assembly comprising:

a vibration damper located in both of a pair of generally confronting passages, one of the pair of generally confronting passages being provided in each of the adjacent spaced apart components; and at least two spaced apart articulation surfaces for contact between the vibration damper and the adjacent components, each of the articulation surfaces: i) being arcuate along the x-axis, and ii) being substantially linear along the y-axis, wherein a dimension of the vibration damper aligned with the x-axis is greater than each dimension of the vibration damper aligned with the y and z-axes.

2. The vibration damper assembly as claimed in claim 1 wherein at least one of the articulation surfaces is formed by the vibration damper.

3. The vibration damper assembly as claimed in claim 2 wherein the vibration damper comprises a neck portion having a minimum cross-sectional area and on either side of the neck portion there are two head portions, each having a maximum cross-sectional area, wherein the two head portions define the at least two spaced apart articulation surfaces.

4. The vibration damper assembly as claimed in claim 3 wherein at least one of the two head portions comprises a tapering portion.

5. The vibration damper assembly as claimed in claim 3 wherein the neck portion comprises a generally varying cross-sectional area.

6. The vibration damper assembly as claimed in claim 1 wherein at least one of the articulation surfaces is formed by one of the adjacent components in one of the confronting passages.

7. The vibration damper assembly as claimed in claim 6 wherein the vibration damper has a contact surface, the contact surface having a generally constant cross-sectional area.

8. The vibration damper assembly as claimed in claim 1 wherein there is an articulation surface formed on the damper and an articulation surface formed by one of the adjacent components in the confronting passages.

9. The vibration damper assembly as claimed in claim 1 wherein a cross-sectional shape of the vibration damper or the confronting passages is non-circular and there is a clearance between the vibration damper and confronting passages that is sufficiently small to prevent rotation of the vibration damper in the confronting passages during use.

10. The vibration damper assembly as claimed in claim 1 wherein a cross-sectional shape of the vibration damper or confronting passages is polygonal.

11. The vibration damper assembly as claimed in claim 10 wherein the cross-sectional shape of the vibration damper or confronting passages is rectangular.

12. The vibration damper assembly as claimed in claim 1 wherein the adjacent components are adjacent blades of an annular array, mounted to a disc in a gas turbine engine.

* * * * *